US005218370A

United States Patent [19]

Blaese

[11] Patent Number: 5,218,370

[45] Date of Patent: Jun. 8, 1993

[54] KNUCKLE SWIVEL ANTENNA FOR PORTABLE TELEPHONE

[76] Inventor: Herbert R. Blaese, 3314 Olcott Ave., Chicago, Ill. 60634

[21] Appl. No.: 654,533

[22] Filed: Feb. 13, 1991

Related U.S. Application Data

[63] Continuation-in-part of Ser. No. 625,915, Dec. 10, 1990, abandoned.

[51] Int. Cl.[5] ..... H01Q 1/24

[52] U.S. Cl. ..... 343/702; 343/906

[58] Field of Search ..... 343/702, 715, 906, 900, 343/888

[56] References Cited

U.S. PATENT DOCUMENTS

| | | | |
|---|---|---|---|
| 3,579,241 | 5/1971 | Antista et al. | 343/702 |
| 3,946,317 | 3/1976 | Ishimaru et al. | 343/702 |
| 4,024,542 | 5/1977 | Ikawa et al. | 343/702 |
| 5,014,346 | 5/1991 | Phillips et al. | 343/702 |

FOREIGN PATENT DOCUMENTS

| | | | |
|---|---|---|---|
| 0050703 | 4/1980 | Japan | 343/702 |
| 0147806 | 11/1980 | Japan | 343/702 |
| 0055704 | 4/1985 | Japan | 343/702 |
| 0072702 | 3/1990 | Japan . | |

OTHER PUBLICATIONS

Clipping from the Chicago Tribune of 5 Dec. 1990 showing a bag phone.

Photocopy of antenna.

*Primary Examiner*—Rolf Hille

*Assistant Examiner*—Hoanganh Le

*Attorney, Agent, or Firm*—Gerstman & Ellis, Ltd.

[57] ABSTRACT

A portable telephone comprises a telephone housing, a connection member having a longitudinal axis attached to said housing and communicating outwardly therefrom, an antenna carried on the connection member, and a pivot system associated with the connection member to permit the antenna to swivel in a plane perpendicular to the longitudinal axis of the outer end of the connection member. Further, a clutch-type system is provided, having first and second bearing faces pressed against each other in sliding, rotary bearing relation for relative movement as the antenna swivels. Finally, a combination of the clutch-type system and the pivot system, allowing for an even greater degree of movement by the antenna, is provided, allowing three dimensional placement of the antenna for optimum reception and transmission of signals.

17 Claims, 3 Drawing Sheets

Fig. 1
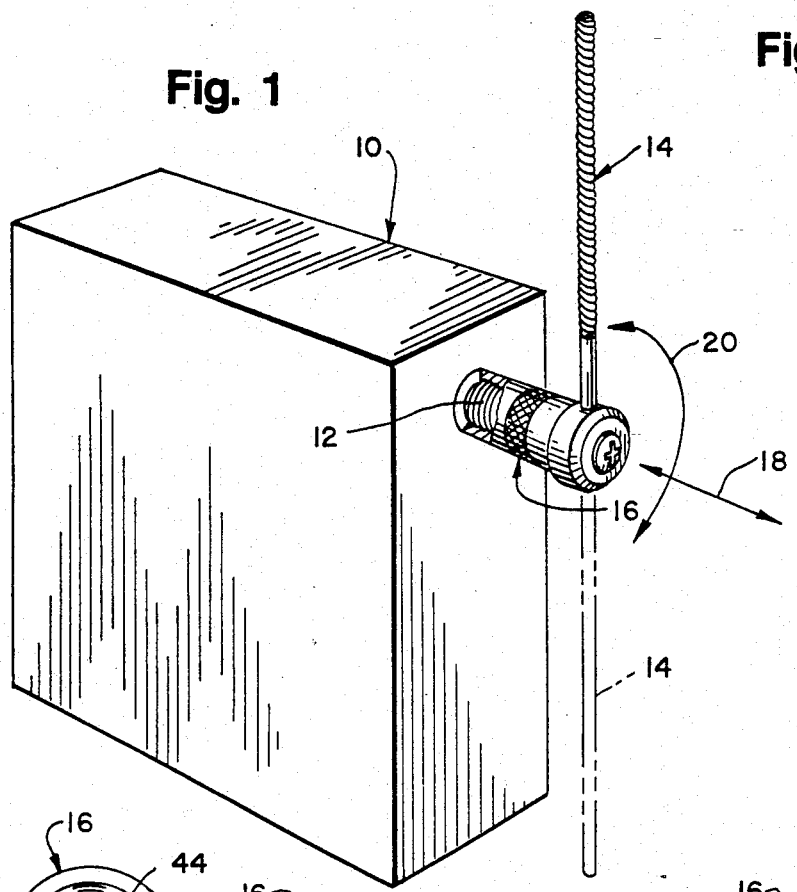
Fig. 2
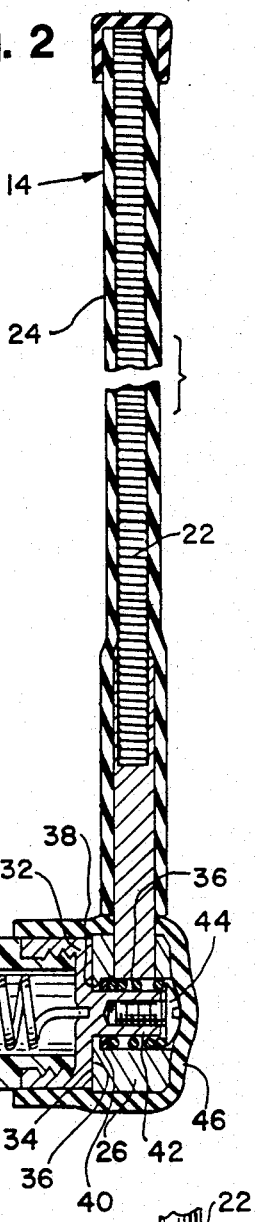
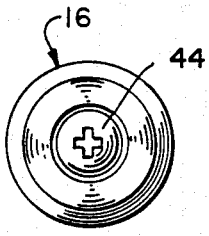
Fig. 3
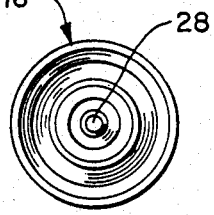
Fig. 4
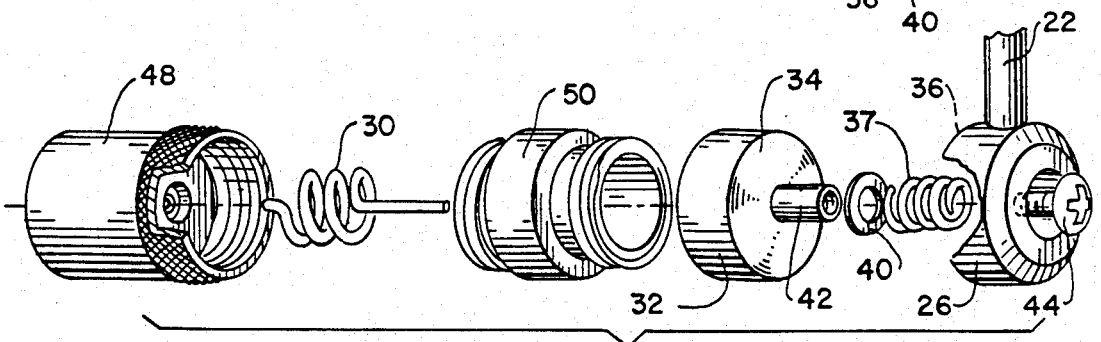
Fig. 5

Fig. 10
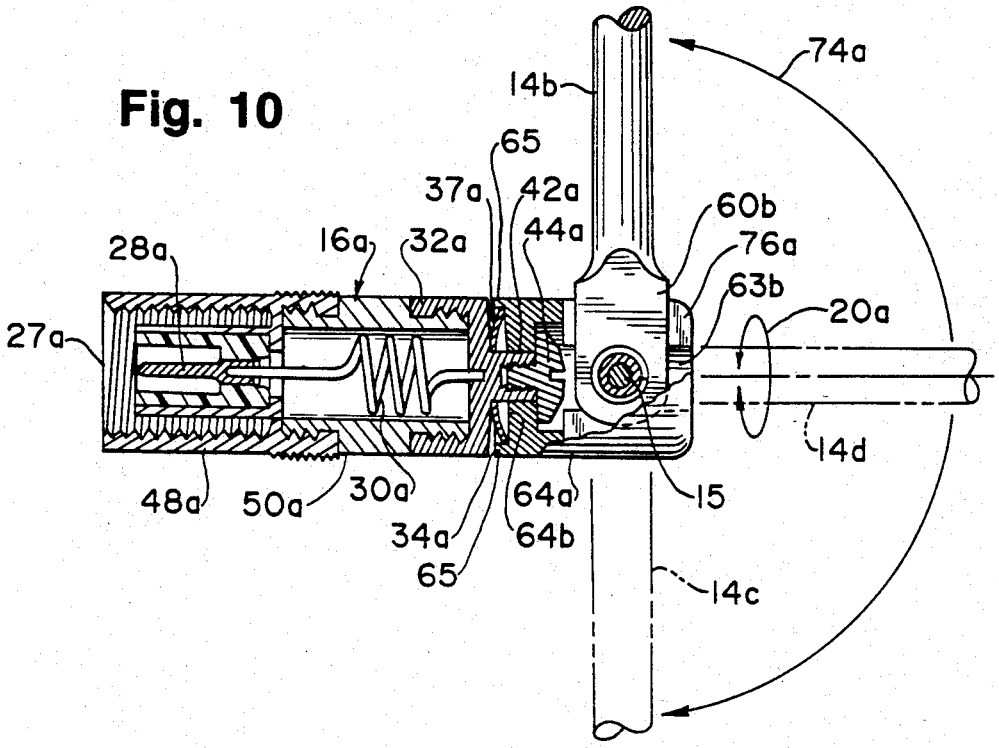
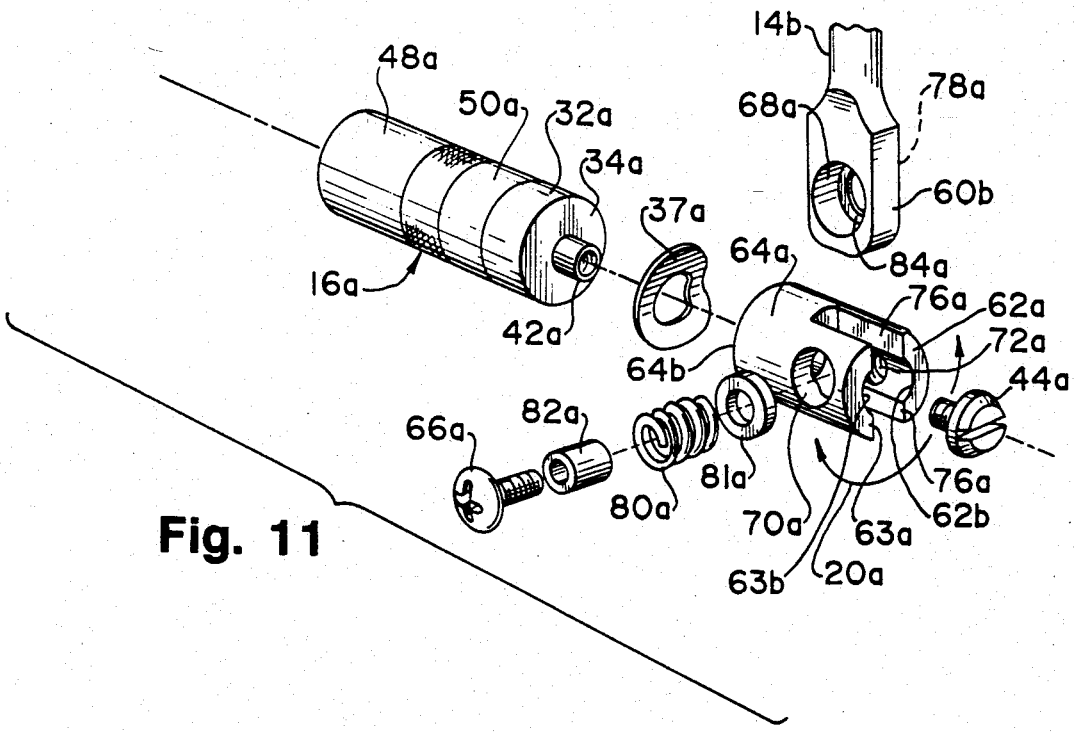
Fig. 11

KNUCKLE SWIVEL ANTENNA FOR PORTABLE TELEPHONE

This application is a continuation-in-part of U.S. application Ser. No. 625,915 filed Dec. 10, 1990, now abandoned.

BACKGROUND OF THE INVENTION

Portable telephones are in growing use, many of them having swivel antennas so that the antenna can be directed in the most favorable direction for transmission and receipt of signals. In conventional, portable telephone swivel antennas, the antenna is carried by a connection member which is attached to the telephone housing. The direction of swivelling of the antenna is basically inwardly and outwardly, generally about an axis that is perpendicular to the longitudinal axis of the connection member. This results in a system in which the antenna can project inconveniently outward with respect to the casing or housing of the telephone.

Also, swivel antennas for telephones and for television sets share in the disadvantage that they tend to lose their self positioning, desired characteristic so that the antenna will not stay in a desired position, but will rather fall downwardly by gravity, since the retention provided to the swivel antenna can wear, and the frictional retention is reduced. In an attempt to remedy this, a bolt is often provided which can be tightened to reestablish frictional retention. In fact in some swivel antennas it is necessary to loosen or tighten the bolt in order to cause it to swivel and then to cause it to be retained in a desired position. Eventually, further wear causes reduction in the frictional retention and further generally tightening proves ineffective.

In accordance with this invention, a swivel antenna connection is provided, preferably for use with portable telephones but also usable in other situations as may be desired. The swivel antenna is retained in any desired swivelling position into which it may be placed, with less possibility of loss of that function through wear. Also, there is no need to tighten a screw to cause the swivelling antenna to remain in its desired position. It is held by a predetermined frictional force in desired swivelling positions, which force does not significantly degrade with use. Thus the undesired loss of frictional positioning function so common with inexpensive TV and telephone antennas of the prior art is not lost with normal use in the antenna mounting of this invention.

It is therefore an object of the present invention to provide a telephone with a swivel antenna that is easy to assemble, inexpensive to manufacture and provides means to achieve the best possible reception and transmission quality while maintaining its position until a new position is desired.

Other objects and advantages of the present invention will become apparent as the description proceeds.

DESCRIPTION OF THE INVENTION

In this invention, a portable telephone is provided, which telephone comprises a telephone housing. A connection member is attached to the housing, which connection member communicates outwardly from that housing. An antenna is carried on the connection member. Means are associated with the connection member to permit the antenna to swivel about the longitudinal axis of the connection member. This different direction of swivelling from normal antennas for small, portable devices provides significant improvement in the convenient storing of the antenna and its projection in directions which are not so directly away from the housing. Thus, the antenna is less obtrusive, while it can still be effectively used to pickup strong signals.

The portable telephone of this invention preferably utilizes a connection member which defines a first bearing face. The attached antenna has a base which defines a second bearing face. The first and second bearing faces abut each other in sliding, rotary bearing relation for relative rotary movement as the antenna swivels.

Preferably, spring means are provided to urge the first and second bearing surfaces together, in which the spring means presses with sufficient strength whereby the antenna is retained in any swivel position to which it is manually rotated, by the frictional retention imparted between the two bearing faces.

It is generally preferred for the connection member, antenna base, and spring means to be secured together by a bolt or other equivalent threaded member.

A rigid tube member is provided through which the bolt extends, to limit the degree of tightening that the bolt can apply to the bearing faces and spring means. In other words, with such a structure it becomes possible to assemble the device and to tighten the bolt as hard as it can be tightened for good retention of the system. Nevertheless, because of the presence of the rigid tube member, the bolt is prevented from totally collapsing the spring member and forcing the two bearing faces together with high pressure. Instead, the pressure between the two bearing faces is governed by the spring member, no matter how hard the bolt is tightened.

The particular pressing strength of the spring member is selected so that the antenna may be firmly positioned in any desired swivelling position, but that there is no difficulty in rotating the antenna and consequently rotating the two bearing faces relative to each other while they are under the constant pressure provided by the spring member. Additionally, as wear takes place between the bearing faces, the presence of the spring member causes the pressure between the two bearing faces to remain at the desired level so that the system does not lose its self positioning characteristic with use.

The rigid tube may be threaded to receive and engage the bolt as shown in one embodiment of this invention below. Alternatively, the rigid tube may be an unthreaded sleeve through which the bolt extends to engage a threaded aperture or the like beyond the rigid tube.

The bearing faces described above, one of which is defined by the antenna base and the other of which is defined by the connection member, may each be formed of an electrically conductive material. Thus, signals to and from the antenna can pass across the abutting bearing faces and through the connection member so that a good electrical connection is provided to and from the antenna despite the swivelling capability thereof.

The connection member may carry an electrically conductive coil as part of the path of the signals through the connection member. Such a coil may serve as an internal phasing coil to provide proper antenna inductance.

The connection member itself may be a two part member. The first part may comprise a coaxial cable jack carried by the telephone housing, while a second connector portion may be attached to the antenna and removably connected to the jack, for example by a sliding connection. Thus the antenna may be easily removed from the telephone housing if that should be desired.

In a second embodiment of the invention the rotation of the antenna is about an axis that is perpendicular to the longitudinal axis of the connection member. The connection member carries a head member upon which an antenna is attached. Spring means are provided causing a conductive surface on the antenna to abut a conductive surface on the head member in a manner analogous to that described in the first embodiment. The abutting faces, bolt and spring, and other components that make up the rotating means of the invention, are positioned perpendicular to the longitudinal axis of the connection member, thus allowing rotation of the antenna about an axis that is perpendicular to the longitudinal axis of the connection member.

In a third embodiment, a combination of the first two embodiments is provided. A connection member and a head member, each having a conductive surface that abuts the other and which are biased by spring means, and an antenna that also has a conductive surface that is spring biased to abut a second conductive surface on the head member, as in the second embodiment above, are provided permitting the rotation of the antenna, about two axes, and the maintenance of any desired position. A first means of rotation is provided at the end of the head member, allowing the positioning of the antenna about an axis perpendicular to the longitudinal axis of the connection member. A second means of rotation is provided about the longitudinal axis of the connection member allowing the positioning of the antenna in any position perpendicular to the longitudinal axis of the connection member. In combination these two rotations allows the positioning, and maintenance, of the antenna in any position about the point where the antenna is attached to the head member.

A more detailed explanation of the invention is provided in the following description and claims, and is illustrated in the accompanying drawings.

DESCRIPTION OF THE DRAWINGS

In the drawings, FIG. 1 is a perspective view of a portable telephone which carries the swivel antenna of this invention;

FIG. 2 is a longitudinal sectional view of the antenna of FIG. 1 and its second connector portion attached thereto, in unconnected relation to the jack carried by the telephone housing;

FIG. 3 is an end view of the outer portion of the second connector portion of FIG. 2, with the rubber boot removed;

FIG. 4 is an end view of the inner portion of the second connector portion of FIG. 2;

FIG. 5 is an exploded perspective view of the second connector portion of FIG. 2, showing a portion of the antenna;

FIG. 10 is a longitudinal sectional view of an antenna of the present invention, its second connector portion and a head member attached thereto, in unconnected relation to the jack carried by the telephone housing;

FIG. 11 is a fragmentary, exploded perspective view of components of the swivel portions of the antenna.

DESCRIPTION OF SPECIFIC EMBODIMENTS

Figure 6:
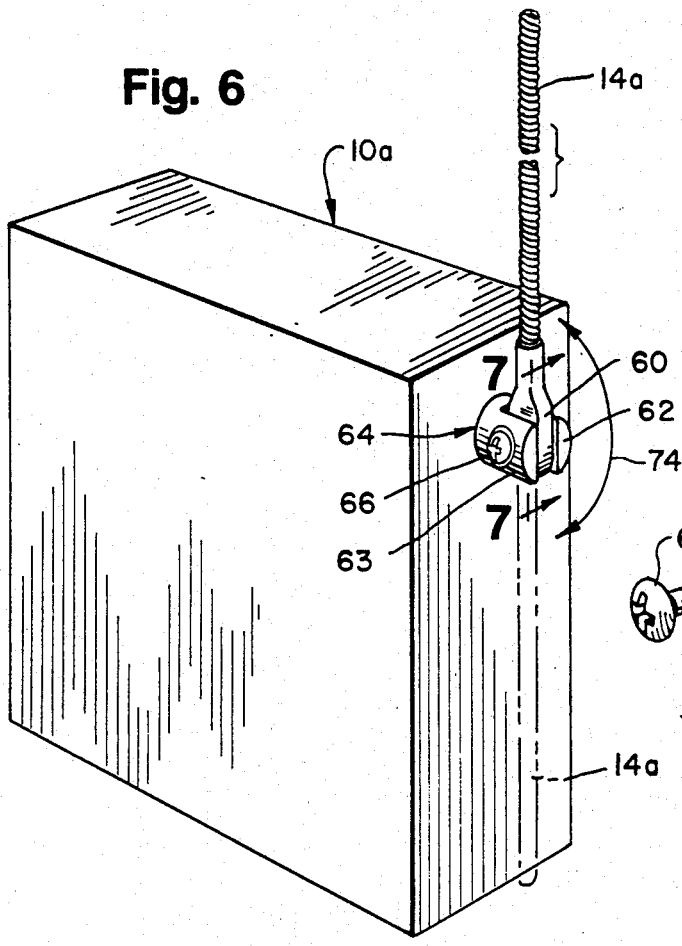
FIG. 6 is a perspective view of a second embodiment of portable telephone which carries a swivel antenna in accordance with this invention.

Referring to FIGS. 1 through 5, a portable telephone is shown having a telephone housing 10, which is indicated in general manner without showing the usual and conventional details of a portable telephone.

Telephone housing 10 defines an outwardly projecting, externally threaded coaxial cable jack 12 which communicates with the internal circuitry of the telephone housing 10 and of course the telephone receiver. Antenna 14 is disclosed, being pivotally connected by means of second connector portion 16 to housing 10 through coaxial cable jack 12. Coaxial cable jack 12 and second connector portion 16 together define the connection member as defined above.

As shown, antenna 14 is capable of swivelling rotation in a plane that is substantially perpendicular to the longitudinal axis 18 of the second connector portion 16 and coaxial cable jack 12, such axis being indicated by arrow 18. The curved arrow 20 and dotted line drawing of antenna 14 in FIG. 1 indicates the perpendicular plane of rotation of antenna 14.

FIG. 2 shows antenna 14 in greater detail, with the antenna comprising an inner spring antenna 22 of conventional design, being surrounded by a rubber dielectric sheath 24, which serves to both protect the antenna, and through its dielectric properties to permit a certain shortening of the antenna to permit the shorter antenna to operate preferably as a $\frac{1}{2}$ or $\frac{5}{8}$ wave length radiator at cellular telephone frequencies of 800 to 1,000 MHz.

Antenna 14 connects to an antenna base 26, which is pivotally carried on second connector portion 16.

The inner end 27 of second connector portion 16 is internally threaded as shown in FIG. 2, and is of a conventional design for connection with coaxial cable connector 12. Internal connector prong 28 is electrically connected with internal phasing coil 30, which is present to provide proper antenna inductance. Internal phasing coil 30 is, in turn, connected to end member 32 which is made of conductive material and which defines a first, annular bearing face 34.

Antenna base 26 is also made of a conductive material and defines second, annular bearing face 36, which, as shown in FIG. 2, is seen to be in abutting relation with first bearing face 34 so that electrical signals can pass across the junction between the two annular faces 34, 36. Thus, since antenna base 26 is electrically connected to conductive inner antenna portion 22, the inner antenna portion 22 is electrically connected to coaxial cable prong 28, for connection between the circuitry of telephone housing 10 and antenna 14.

Antenna base 26 is shown to carry coil spring 37 which presses at one end against an internal annular step 38 through a washer 40, to press bearing face 36 of antenna base 26 and bearing face 34 of end member 32 together with a predetermined force. End member 32 defines an outwardly projecting, internally threaded sleeve 42 into which is threaded a large-head bolt 44 which serves to retain the outer end of coil spring 37, to permit such pressure of the respective faces 34, 36 to take place.

Thus, it can be seen that the pressure applied between the faces 34, 36 is a function of the strength of spring 37. A spring 37 of desired strength may be selected so that antenna 14 may reliably stay at any desired rotary position due to the frictional retentive force between faces 34, 36, but that it may be manually rotated to any other desired position, where it will also stay. It can also be seen that bolt 44 can be tightened against the outer end of tube 42 with maximum force to retain the system together, while at the same time, spring 37 is not fully compressed by this tightening action, nor is the pressure between faces 34, 36 governed by such tightening.

A rubber boot 46 may be applied over antenna base 26 and surrounding parts as shown in FIG. 2.

Second connector portion 16 may comprise a pair of sections 48, 50 which are threaded together in the manner shown, for convenience of assembly of the product.

Thus a portable telephone and an antenna mounting are provided in which the antenna retains desired, fixed swivelling or pivoting position without wear or loosening up during long use. Because of the spring-biased structure of this invention, a non-wearing swivel mechanism is provided for the antenna which frictionally but movably holds the antenna as may be desired.

Referring to FIGS. 6 through 9, another embodiment of the portable telephone of this invention is disclosed. As in the previous embodiment, telephone housing **10*a* may be of conventional design, having in this instance a pivotable antenna 14*a* which has an antenna base 60 pivotably carried between a pair of forked projections 62, 63, which projections are part of a head member 64 which communicates with the circuitry of telephone 10*a*. A bolt 66 extends horizontally through an aperture 68 in antenna base 60, as well as through differently sized apertures 70, 72 of the respective forked projections 62, 63 to retain antenna 14*a* in vertical swivelling relation with telephone housing 10*a*. As a difference from the previous embodiment, the plane of the direction of swivelling as indicated by arrow 74 is generally about an axis perpendicular to the longitudinal axis of head member 64, to provide a direction of rotation which is different from and perpendicular to the direction of rotation of the embodiment of FIG. 1**.

A first bearing face 76 is defined on head member 64, specifically on one of the forked projections 72. A second bearing face 78 is defined on antenna base 60. The aperture 68 in antenna base 60 not only contains bolt 66, but also a coil spring 80, which is generally analogous in function to coil spring 37 of the previous embodiment. Coil spring 80 presses against a washer 81 at one end, which washer, in turn, presses against an annular flange 84 which is an integral part of antenna base 60, serving to narrow the dimension of aperture 68 at an inner position thereof.

The other end of coil spring 80 is retained by the head of bolt 66, while bolt 66 is threadedly engaged with internal threads of aperture 72 for retention thereof in position. Additionally, a rigid tubular sleeve 82 is provided within spring 80, with one end of sleeve 82 pressing against washer 81, and the other end of sleeve 82 typically pressing against the head of bolt 66.

Figure 8:
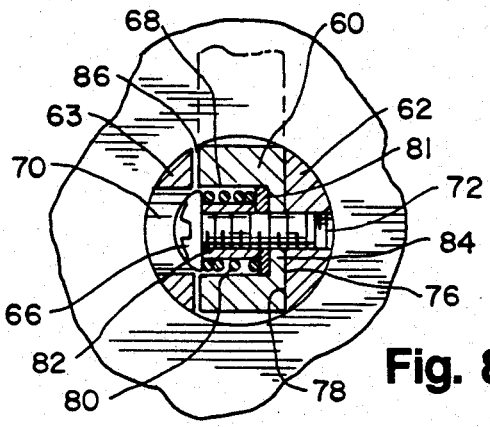
FIG. 8 is a fragmentary sectional view taken along line 8—8 of FIG. 7.

Thus, as in the previous embodiment, as this structure is assembled as shown in FIG. 8, bolt 66 may be tightened to the maximum degree to secure the various components together, without crushing spring 80 down to a maximum level of compression. Instead, spring 80 is compressed only to essentially the length of rigid sleeve 82, which is longer than the fully collapsed spring 80. Bolt 66 thus draws surface 76 of forked projection 62 into engagement with surface 78 of antenna base 60, with the pressure of said engagement being chiefly governed by the compression force of spring 80. The other forked projection 63 may be loosely retained by or separated from antenna base 60, if desired, or the head of bolt 66 may be retained in the aperture 70 of forked projection 63 for firm retention of the swivelling antenna.

Thus, antenna **14*a* may be frictionally retained by bearing faces 76, 78 in any desired pivoting position between the full line position of antenna 14*a* and the phantom line position thereof as shown in FIG. 6. This frictional retention is created by the pressure of spring 80, to provide a manually pivotable antenna which retains its position in a non-wearing manner, since any amount of wear is compensated for by the constant bias force of spring 80. However, the pressure against the respective surfaces 76, 78** is not excessive so as to interfere with pivoting or to create excessive wear.

Figure 9:
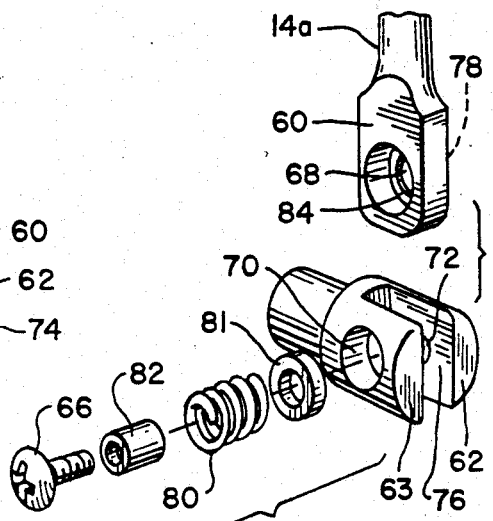
FIG. 9 is a fragmentary, exploded perspective view of components of the swivel portion of the antenna.
Figure 7:
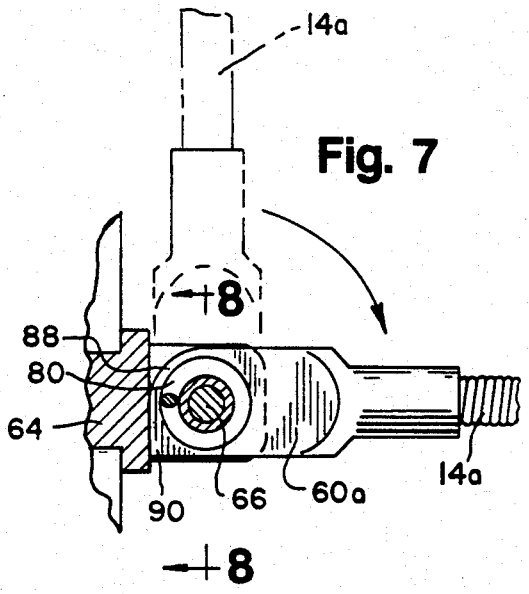
FIG. 7 is a fragmentary elevational view, taken partly in section along line 7—7 of FIG. 6.

The embodiment of FIG. 9 shows an antenna base which is shaped to permit 180° rotation of antenna **14*a*. By way of slight modification, if it is desired to cause antenna 14*a* to rotate only 90°, antenna base 60*a* may be modified to have one rounded inner corner 88 and one square corner 90, to limit the antenna rotation to 90° due to interference at antenna base 60*a* with the face of head member 64 between forked members 62, 63**.

Thus the two embodiments disclosed in FIGS. 6 through 9 also provide the desirable features of an essentially non-wearing, frictional, pivotable retention of an antenna which may be positioned in any desired, swivelled configuration without loosening with wear and without requiring the opening and closing of a screw for securance thereof.

Referring to FIGS. 10 and 11 a further embodiment of the portable telephone of this invention is disclosed. In this embodiment a combination of the first and second embodiments is made allowing the antenna to swivel to any position in a hemisphere whose radius is defined by the length of antenna **14*b* and whose base is centered about hub 15**.

As in the two previous embodiments, the portable telephone housing, here not shown attached but previously shown as 10 and **10*a*, may be of conventional design, having in this instance a three dimensionally pivotable antenna 14*b* which has an antenna base 60*b* pivotably carried between a pair of forked projections 62*a*, 63*a*, which projections are part of head member 64*a*. The forked projections 62*a*, 63*a* have interior wall parts 62*b*, 63*b*, respectively, formed to allow clearance for a bolt 44*a***, whose function will be described in detail below.

A bolt **66*a* extends horizontally through an aperture 68*a* in antenna base 60*b*, as well as through differently sized apertures 70*a*, 72*a* of the respective forked projections 62*a*, 63*a* to retain antenna 14*b*** in vertical swivelling relation with a telephone housing.

As in the last embodiment, a first bearing face **76*a* is defined on head member 64*a*, specifically on one of the forked projections 62*a*. A second bearing face 78*a* is defined on antenna base 60*b*. The aperture 68*a* in antenna base 60*b* not only contains bolt 66*a*, but also a coil spring 80*a*, which is generally analogous in function to coil spring 37 of the first embodiment. Coil spring 80*a* presses against a washer 81*a* at one end, which washer, in turn, presses against an annular flange 84*a* which is an integral part of antenna base 60*b*, serving to narrow the dimension of aperture 68*a*** at an inner position thereof.

The other end of coil spring **80*a* is retained by the head of bolt 66*a*, while bolt 66*a* is threadedly engaged with internal threads of aperture 72a for retention thereof in position. Additionally, a rigid tubular sleeve 82a is provided within spring 80a, with one end of sleeve 82a pressing against washer 81a, and the other end of sleeve 82a typically pressing against the head of bolt 66a**.

Thus, as in the two previous embodiments, as this structure is assembled bolt 66a may be tightened to the maximum degree to secure the various components together, without crushing spring 80a down to a maximum level of compression.

Antenna 14b may, therefore, be frictionally retained by bearing faces 76a, 78a in any desired pivoting position between the full line position of antenna 14b and the phantom line position 14c, as shown in FIG. 10. This frictional retention is created by the pressure of spring 80a, to provide a manually pivotable antenna which retains its position in a non-wearing manner, since any amount of wear is compensated for by the constant bias force of spring 80a. However, the pressure against the respective surfaces 76a, 78a is not excessive so as to interfere with pivoting or to create excessive wear.

Further to this embodiment, is a second connection portion 16a which is provided to allow the antenna 14b to swivel about the longitudinal axis of the connection member. Thus, in combination with the head member 64a, described above, three dimensional rotation of the antenna 14b is possible.

As in the first embodiment of this invention, a telephone housing defines an outwardly projecting, externally threaded coaxial cable connector, illustrated as cable connector 12 in FIG. 1. Cable connector 12 communicates with the internal circuitry of the telephone housing and the telephone receiver not illustrated here.-head member 64a is rotationally connected to mid member 32a, analogous to the connection of antenna base 26 with end member 32 in the first illustrative embodiment.

The inner end 27a of second connection portion 16a is internally threaded, in a like manner to the cable connector shown in FIG. 2, and is of a conventional design for connection with a coaxial cable connector. Internal connector prong 28a is electrically connected with internal phasing coil 30a, which is present to provide proper antenna inductance. Internal phasing coil 30a is, in turn, connected to mid member 32a which is made of conductive material and which defines a first, annular bearing face 34a.

Head member 64a is also made of a conductive material and defines a second annular bearing face 64b, which, as shown in FIG. 10, is seen to be in abutting relation with a Belleville spring 37a, which is a frustro conical section spring, made of conductive material, and which is in turn in an abutting relationship with bearing face 34a, in this way electrical signals can pass across the junction of the two annular faces 34a and 64b and the spring 37a. Thus, head member 64a is electrically connected to antenna 14b, and antenna 14b is thereby electrically connected to coaxial cable prong 28, completing the circuitry between a telephone housing and antenna 14b.

Mid member 32a defines an outwardly projecting, internally threaded sleeve 42a into which is threaded, through head member 64a via wall parts 62b, 63b of forked projections 62a, 63a, respectively, a large-head bolt 44a. A Belleville spring 37a, placed between head member 64a and mid member 32a about the threaded sleeve 42a, and held in place by a rim 65, which is an integral part of head member 64a, serves to separate head member 64a from mid member 32a, allowing rotation of head member 64a perpendicular to the longitudinal axis of the connection member, while maintaining the contact necessary to the completion of the electrical circuit between a telephone and an antenna 14b.

Thus, it can be seen that the pressure applied between the faces 34a, 64b is a function of the strength of spring 37a. A spring 37a of desired strength may be selected so that antenna 14b may reliably stay at any desired rotary position due to the frictional retentive force between faces 34a, 64b, but that it may be manually rotated to any other desired position, where it will also stay. It can also be seen that bolt 44a can be tightened against the outer end of tube 42a with maximum force to retain the system together, while at the same time, due in part to rim 65, spring 37a is not fully compressed by this tightening action.

Second connection portion 16a may comprise a pair of sections 48a, 50a which are threaded together in the manner shown, for convenience of assembly of the product.

Thus a portable telephone and an antenna mounting are provided in which the antenna retains desired, fixed swivelling or pivoting positions without wear or loosening up during long use. Because of the dual spring-biased structure of this invention, non-wearing swivel mechanisms are provided for the antenna which frictionally but movably hold the antenna as may be desired.

The swivel antenna and its connection disclosed herein is preferably used in conjunction with a portable telephone, but it may also be used as desired with two way radios, portable radios, TV sets or any other desired use.

The above has been offered for illustrative purposes only, and is not intended to limit the scope of the invention of this application, which is as defined in the claims below.

That which is claimed is:

1. A portable telephone which comprises a telephone housing, a connection member defining a longitudinal axis of the outer end thereof, said member being attached to said housing and communicating outwardly therefrom, an antenna carried on the outer end of said connection member and means associated with said connection member to permit said antenna to swivel in a plane substantially perpendicular to said longitudinal axis and remain in a set position, said means associated with said connection member defining a first bearing face, said antenna having a base which defines a second bearing face, said first and second bearing faces abutting each other, continuously in area contact, in sliding, rotary bearing relation for relative movement as said antenna swivels, said portable telephone having spring means, carried proximate to said first and second bearing faces, urging said first and second bearing faces together.

2. The portable telephone of claim 1 in which said connection member, antenna base, and spring means are secured together by a bolt means, said bolt means comprising a bolt and a rigid tube member through which said bolt extends to limit the degree of tightening that said bolt applies to said bearing faces and spring means.

3. The portable telephone of claim 1 in which said spring means presses with sufficient strength to retain said antenna in one of a plurality of swivel positions.

4. A swivel antenna and connection with an antenna mounting, which comprises:

a connection member for securing an antenna to a housing, said connection member defining means for connection with said housing and a first bearing face, said antenna having a base which defines a second bearing face, spring means carried by said connection member continually urging said first and second bearing faces together, said first and second bearing faces continually abutting each other in sliding, rotary bearing relation for relative movement as said antenna swivels.

5. The portable antenna of claim 4 in which said means urging said first and second bearing face together is a spring carried proximate to said first and second bearing faces.

6. The portable telephone of claim 5 in which said connection member, antenna base, and spring are secured together by a bolt means, said bolt means comprising a bolt and a rigid tube member through which said bolt extends to limit the degree of tightening that said bolt applies to said faces and spring means.

7. The portable telephone of claim 6 in which said spring presses with sufficient strength to retain said antenna in one of a plurality of swivel positions.

8. The portable telephone of claim 7 in which said bearing faces are defined by electrically conductive materials and electrical signals to and from said antenna pass across said bearing faces and through the connection member.

9. The portable telephone of claim 8 in which said connection member carries an electrically conductive coil as part of the path of said signals through said connection member.

10. The portable telephone of claim 9 in which said connection member comprises a coaxial cable jack carried by said housing and a second connector portion attached to said antenna and removably connected to said jack.

11. The portable telephone of claim 10 in which means are associated with said connection member to permit said antenna to swivel in a plane substantially perpendicular to the longitudinal axis of the outer end of said connection member.

12. A portable telephone which comprises a telephone housing, a connection member having a longitudinal axis attached to said housing and communicating outwardly therefrom, an antenna carried on said connection member, and means, to permit said antenna to swivel in a plane substantially perpendicular to said longitudinal axis, associated with said connection member, said means associated with the connection member defining a first bearing face, said antenna having a base which defines a second bearing face, said first and second bearing faces abutting each other, continuously in area contact, in sliding, rotary bearing relation as said antenna swivels; said bearing faces being defined by electrically conductive materials, whereby electrical signals to and from said antenna pass across said abutting faces and through said connection member; and, spring means, carried by said connection member, urging said first and second bearing faces together with sufficient strength to retain said antenna in one of a plurality of swivel positions.

13. A portable telephone which comprises a telephone housing, a connection member defining a first electrically conductive bearing face and a first longitudinal axis, said connection member being attached to said housing and communicating outwardly therefrom, a head member defining a second longitudinal axis perpendicular to said first longitudinal axis and a second electrically conductive bearing face abutting, continuously in area contact, said first electrically conductive bearing face of said connection member in sliding rotary bearing relation for relative movement as said antenna rotates and a third electrically conductive bearing face, a first spring, carried proximate to said first and second bearing faces, urging said first bearing face and said second bearing face together, an antenna defining a fourth electrically conductive bearing face, rotationally attached to said head member and abutting, continuously in area contact, said third electrically conductive bearing face of said head member in sliding rotary bearing relation for relative movement as said antenna pivots, and a second spring, carried proximate to said third and fourth bearing faces, urging said third bearing face and said fourth bearing face together allowing said antenna to pivot about said second longitudinal axis and rotate about said first longitudinal axis.

14. The portable telephone of claim 13 in which said head member, antenna, and spring means are secured together by a first bolt and a first rigid tube member, said head member and connection member and spring means are secured together by a second bolt and a second rigid tube member, said first and second bolts, respectively, positioned within said first and second tube members to limit the degree of tightening that said bolts apply to said respective bearing faces and spring means.

15. The portable telephone of claim 13 in which said spring means press with sufficient strength to retain said antenna in any position.

16. The portable telephone of claim 13 in which said connection member carries an electrically conductive coil as part of the path of said signals between said antenna and said housing.

17. A portable telephone which comprises a telephone housing, a connection member defining a first bearing face and a first longitudinal axis, said connection member being attached to said housing and communicating outwardly therefrom, a head member defining a second longitudinal axis perpendicular to said first longitudinal axis and a second bearing face abutting, continuously in area contact, said first bearing face of said connection member in sliding rotary bearing relation for relative movement as said antenna rotates and a third bearing face, and an antenna defining a fourth bearing face, rotationally attached to said head member and abutting, continuously in area contact, said third bearing face of said head member in sliding rotary bearing relation for relative movement as said antenna pivots, allowing said antenna to pivot about said second longitudinal axis and rotate about said first longitudinal axis said portable telephone having first spring means, carried proximate to said first and second bearing faces, urging said first and second bearing faces together and second spring means, carried proximate to said third and fourth bearing faces urging said third and fourth bearing faces together.

* * * * *